US012698779B2

(12) United States Patent
Dienst et al.

(10) Patent No.: US 12,698,779 B2
(45) Date of Patent: Aug. 4, 2026

(54) FAN DEVICE FOR RADIATOR

(71) Applicant: MAHLE International GmbH, Stuttgart (DE)

(72) Inventors: Sebastian Dienst, Numazu (JP); Yujiro Sugiyama, Numazu (JP); Ryosuke Suzuki, Numazu (JP); Yoshio Matsukawa, Numazu (JP); Namgyu Han, Numazu (JP); Kenzo Yoshida, Numazu (JP)

(73) Assignee: Mahle International GmbH (DE)

( * ) Notice: Subject to any disclaimer, the term of this patent is extended or adjusted under 35 U.S.C. 154(b) by 0 days.

(21) Appl. No.: 19/002,670

(22) Filed: Dec. 26, 2024

(65) Prior Publication Data

US 2025/0327459 A1 Oct. 23, 2025

(30) Foreign Application Priority Data

Dec. 27, 2023 (JP) ..... 2023-220562

(51) Int. Cl.
*F04D 25/06* (2006.01)
*F04D 19/00* (2006.01)
*F01P 5/04* (2006.01)

(52) U.S. Cl.
CPC ..... *F04D 25/062* (2013.01); *F04D 19/002* (2013.01); *F01P 2005/046* (2013.01); *F04D 25/0693* (2013.01)

(58) Field of Classification Search
CPC ..... F04B 19/002; F04B 25/0613; F04B 25/0693; F01P 2005/046; B60K 11/06; H02K 2203/09; H02K 2203/06; H02K 2203/03; H02K 5/225; F04D 19/002; F04D 25/0613; F04D 25/0693
See application file for complete search history.

(56) References Cited

U.S. PATENT DOCUMENTS 5,663,604 A * 9/1997 Takahashi ..... F04D 25/0646 310/67 R
10,756,595 B2 * 8/2020 Le Goff ..... H02K 9/227
2012/0248908 A1 * 10/2012 Zahora ..... F04D 29/5806 310/60 A
2015/0340916 A1 * 11/2015 Kang ..... F04D 29/329 310/156.12

FOREIGN PATENT DOCUMENTS

JP 2020048298 A 3/2020

* cited by examiner

*Primary Examiner* — Thomas Fink
(74) *Attorney, Agent, or Firm* — Fishman Stewart PLLC

(57) ABSTRACT

A radiator fan device may include a fan, a motor connected to the fan, and a shroud overlying the fan and the motor. The fan may include a hub and a plurality of blades projecting from the hub. The motor may be configured to rotationally drive the fan. The shroud may integrally include a shroud body overlying the fan and the motor and/or a motor anchor part securing the motor to the shroud.

19 Claims, 5 Drawing Sheets

FAN DEVICE FOR RADIATOR

CROSS-REFERENCE TO RELATED APPLICATION

This application claims priority to Japanese Patent Application No. 2023-220562, filed on Dec. 27, 2023, the contents of which is hereby incorporated by reference in its entirety

TECHNICAL FIELD

The present invention relates to a radiator fan device.

BACKGROUND

In general, in cooling radiator fan devices (hereinafter referred to as a "radiator fan device") used to cool water-cooled engines, a shroud is provided to cover the fan and the motor that drives the fan to rotate. (see, for example, Patent Literature 1).

[Patent Literature 1] Japanese Unexamined Patent Application Publication Number 2020-48298.

SUMMARY

Incidentally, in conventional radiator fan devices, the motor was attached to the shroud via a plate secured to the stator. In other words, conventional radiator fan devices have the problem of the fan devices for the radiator part of the plate being heavy.

The present invention is intended to provide a radiator fan device that is capable of being lighter by way of example of the above-mentioned problem.

To achieve the above objective, a radiator fan device according to the present invention comprises a fan having a plurality of blades provided in the hub, a motor to rotationally drive said fan, and a shroud overlying said fan and said motor, said shroud comprising a shroud body overlying said fan and said motor, and a motor anchoring part securing said motor.

In a radiator fan device according to one aspect of the present invention, the motor comprises a stator having a stator core with a cylindrical bearing support hole formed, a rotational axis disposed in the bearing support hole to which the fan is attached, and a pair of bearings arranged in an axis direction within the bearing support hole to rotatably support the rotational axis with respect to the stator core, the stator having an engaging part with the motor anchor part, the motor anchor part having an engaging part with the engaging part.

In a radiator fan device according to one aspect of the present invention, the engaging part and the engaged part have shapes that fit together.

According to the radiator fan device according to the present invention, weight reduction can be achieved.

DETAILED DESCRIPTION

Below is a description of the radiator fan device according to an embodiment of the present invention with reference to the drawings.

Figure 1:
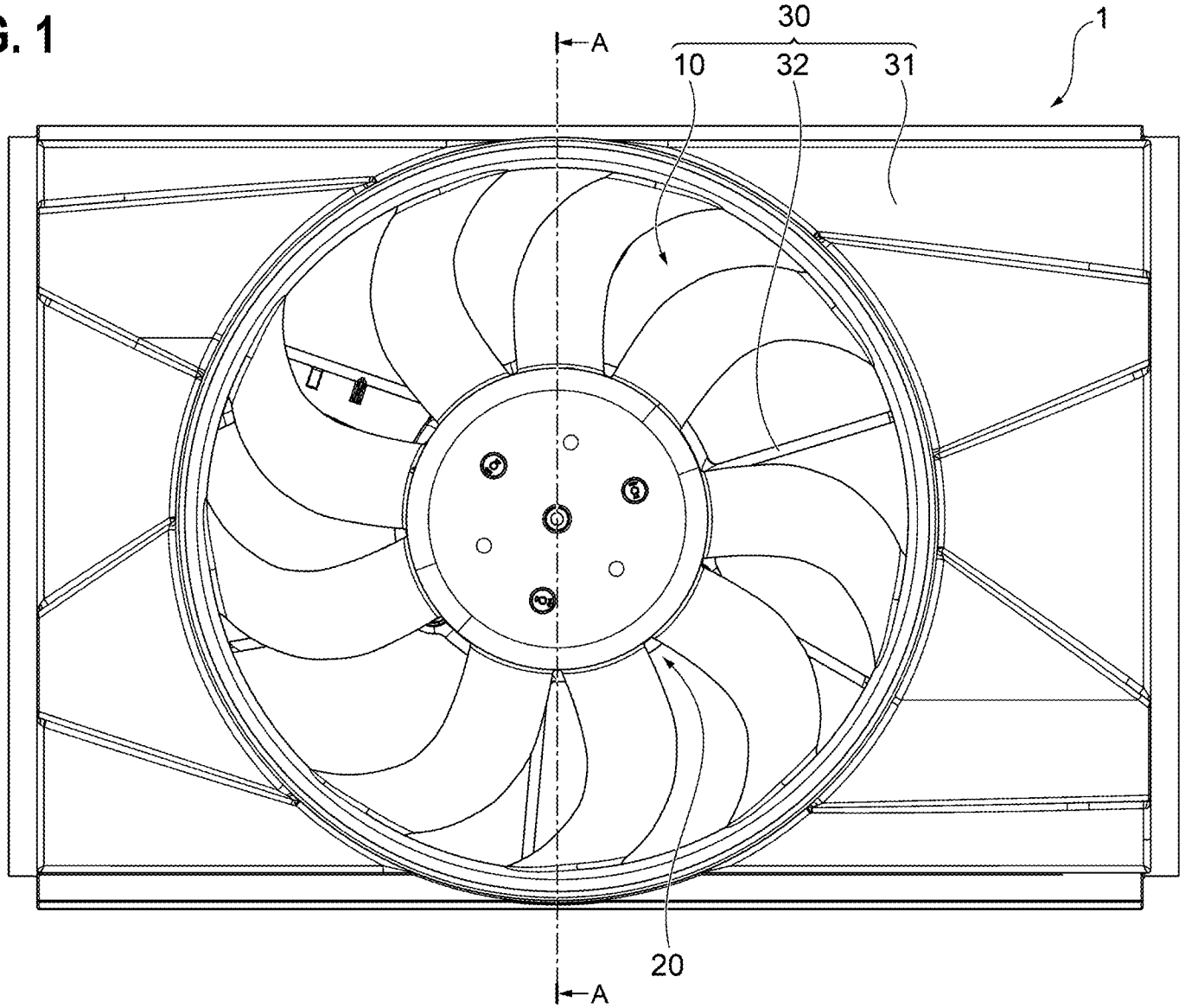
FIG. 1 shows a front view schematically showing the configuration of a radiator fan device according to the embodiment of the present invention.
Figure 2:
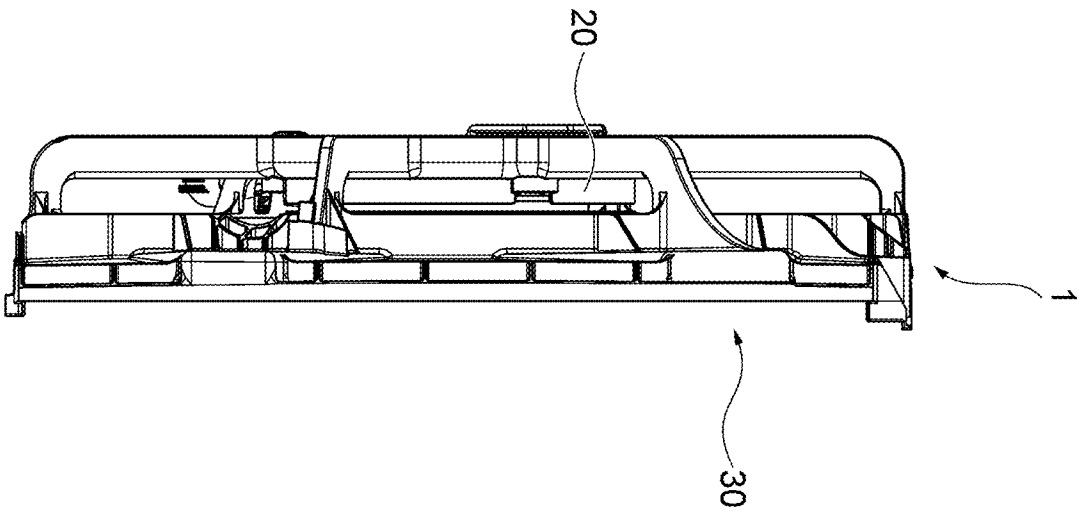
FIG. 2 shows a side view schematically showing the configuration of the radiator fan device shown in FIG. 1.
Figure 3:
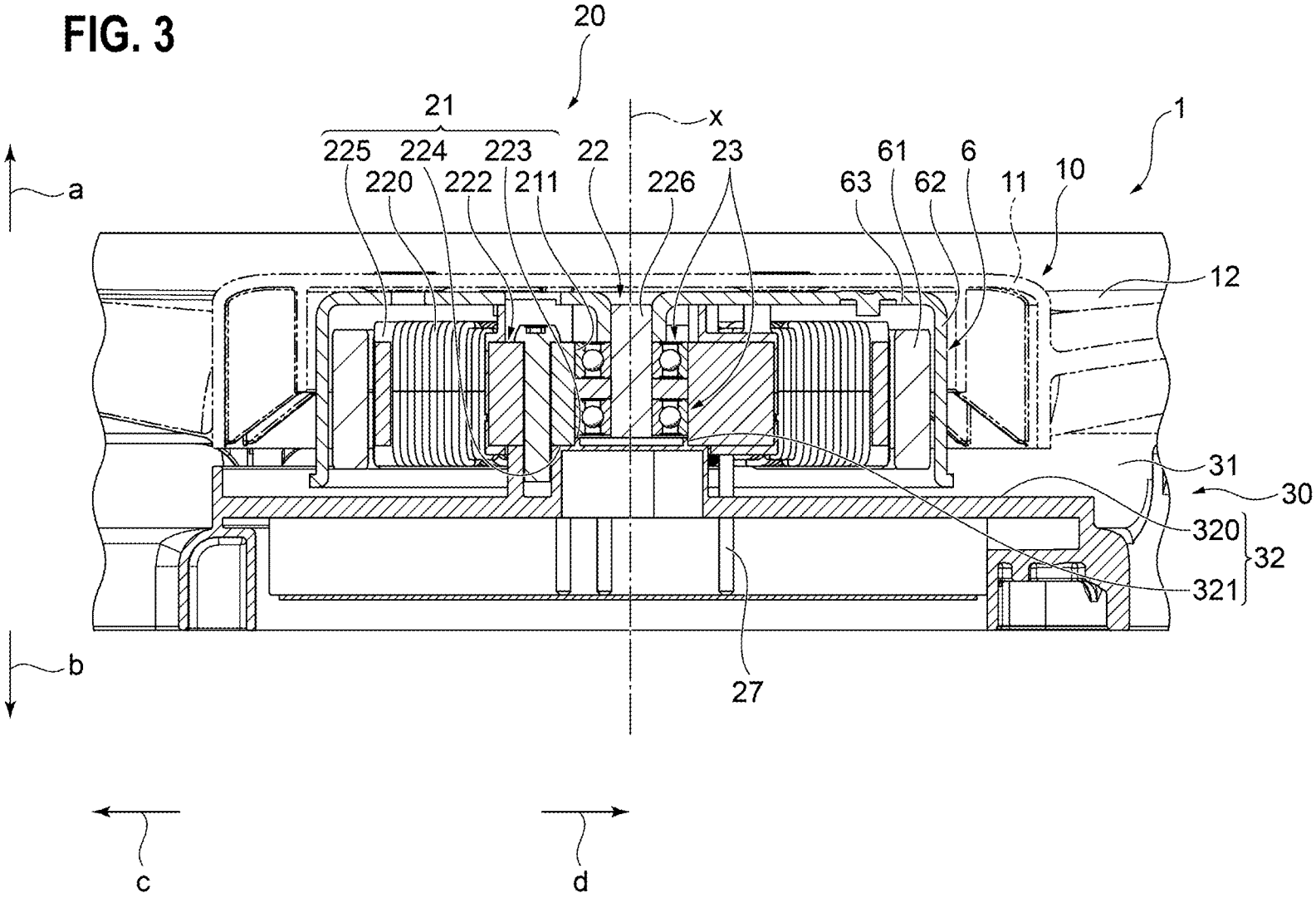
FIG. 3 shows a close-up cross-section view of the radiator fan device shown in FIG. 1.

FIG. 1 is a front view schematically illustrating a configuration of a radiator fan device 1 according to an embodiment of the present invention. FIG. 2 shows a schematic side view of radiator fan device 1. FIG. 3 is an enlarged cross-section view of radiator fan device 1.

In the following explanation, for convenience, the direction of arrow a in the direction of axis x (hereinafter referred to as the "axis direction") shown in FIG. 3 is referred to as the upper side a, and the direction of arrow b as the lower side b. Also, in the radial direction perpendicular to axis x, the direction away from axis x (arrow c direction in FIG. 3) is the outer circumferential side c, and the direction toward axis x (arrow d direction in FIG. 3) is the inner circumferential side d. In the following description, for convenience, the direction shown in FIG. 3 is the side of the motor 20.

As shown in FIGS. 1-3, the radiator fan device 1 according to the present embodiment comprises a fan 10 provided with a plurality of blades 12 in the hub 11, a motor 20 to rotationally drive the fan 10, and a shroud 30 covering the fan 10 and the motor 20. In radiator fan device 1, the shroud 30 is integrally composed of a shroud body 31 covering the fan 10 and the motor 20 and a motor anchor part 32 securing the motor 20.

In the radiator fan device 1, for example, the motor 20 comprises a stator 21 having a stator core 222 formed with a cylindrical bearing retaining hole 211, a rotational axis 22 disposed in the bearing retaining hole 211 to which the fan 10 is mounted, and a pair of bearings 23 disposed in the bearing retaining hole 211 in an axial direction to rotatably support the rotational axis 22 relative to the stator core 222, the stator 21 having an engaging part 223 with the motor anchor part 32 and the motor anchor part 32 having an engaged part 321 with the engaging part 223.

At the stator 21 of the motor 20, for example, the engaging part 223 and the engaged part 321 have shapes that fit together.

As shown in FIGS. 1 and 2, a radiator fan device 1 is provided in a vehicle for introducing outside air into a non-illustrated radiator that cools a coolant of a water-cooled engine of a non-illustrated vehicle, such as, for example, an automobile or a motorcycle. A radiator fan device 1 is generally provided on a rear (rear of the vehicle in the direction of travel) or a front (front of the direction of travel) side of the radiator. The radiator fan device 1, when the coolant exceeds the specified temperature during a stop or low speed operation, causes the motor 20 to be driven rotationally to pump outside air into the radiator by the fan 10, forcing the coolant in the radiator to cool.

As shown in FIG. 3, the motor 20 includes a rotor 6 in addition to the main components described above, i.e. the stator 21, the axis of rotation 22, and a pair of bearings 23. Motor 20 is an outer rotor type motor, for example, a brushless DC (DC) motor.

The stator 21 comprises a stator core 222 and an engaging part 223 as described above, as well as a coil 220 and an insulator 225.

The stator core 222 is formed in an annular or generally annular periphery to form a cylindrical bearing retention hole 211 in the inner periphery. The stator core 222 is composed of a plurality of laminated thin sheets of annular magnetic material, such as steel plates. In FIG. 3, the illustration of the thin plate constituting the stator core 222 is omitted.

The coil 220 is wound around the stator core 222 via the insulator 225. The insulator 225 is an insulating member attached to the stator core 222.

A pair of bearings 23 are arranged in line with the bearing support holes 211 in an axial direction. The pair of bearings 23 rotatably support the rotational axis 22 relative to the stator core 222. A pair of bearings 23 are press fit into the inner circumferential surface of the bearing support hole 211 of the stator core 222. A pair of bearings 23 are spaced apart in the bearing retention holes 211 in the axis direction of the axis of rotation 22.

One of the pair of bearings 23 is provided on an axial side of the rotational axis 22. The other of the pair of bearings 23 is provided below the axis direction of the rotation axis 22. The pair of bearings 23 are ball bearings comprising an inner and outer ring as well as a rolling element provided between the inner and outer rings.

The engaging part 223 is a part of the axial underside (opposite the side on which the rotor 6 is provided) of the bearing support hole 211 at the stator core 222. That is, the engaging part 223 uses a part of the bearing retaining hole 211 to secure the motor 20 and the shroud 30.

The engaging part 223 is a site that engages the motor anchor part 32 and the stator core 222. The engaging part 223 has a shape that is engageable with the engaged part 321 provided in the motor anchor part 32. The engaging part 223 is, for example, a cylindrical or generally cylindrical hole formed in a concave shape from a bottom surface 224 on an axial lower side of the stator core 222 towards an axial upper side.

As shown in FIGS. 1-3, in the radiator fan device 1, the shroud 30 covers between the peripheral side of the fan 10 and the front or rear side of the unillustrated radiator. The shroud 30 is composed of a shroud body 31 and a motor anchor part 32 integrally by means of a resin material, etc.

The shroud body 31 forms a schematic shape of the shroud 30 that covers between the peripheral side of the fan 10 and the radiator. A motor anchor part 32 is provided to secure the motor 20 to the shroud 30.

Figure 4:
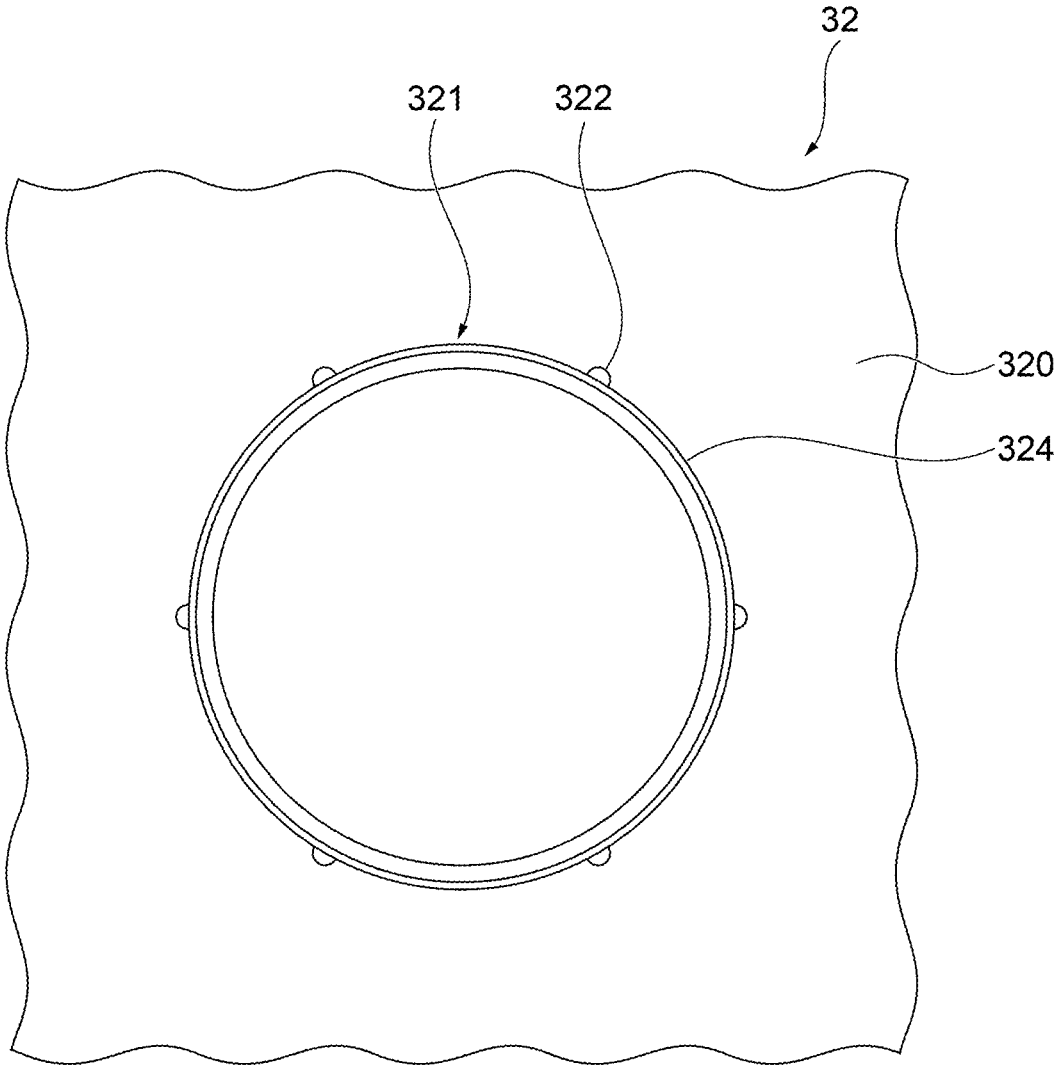
FIG. 4 shows a front view of the engaged part of the motor fixation part provided by the shroud of the radiator fan device shown in FIG. 1.
Figure 5:
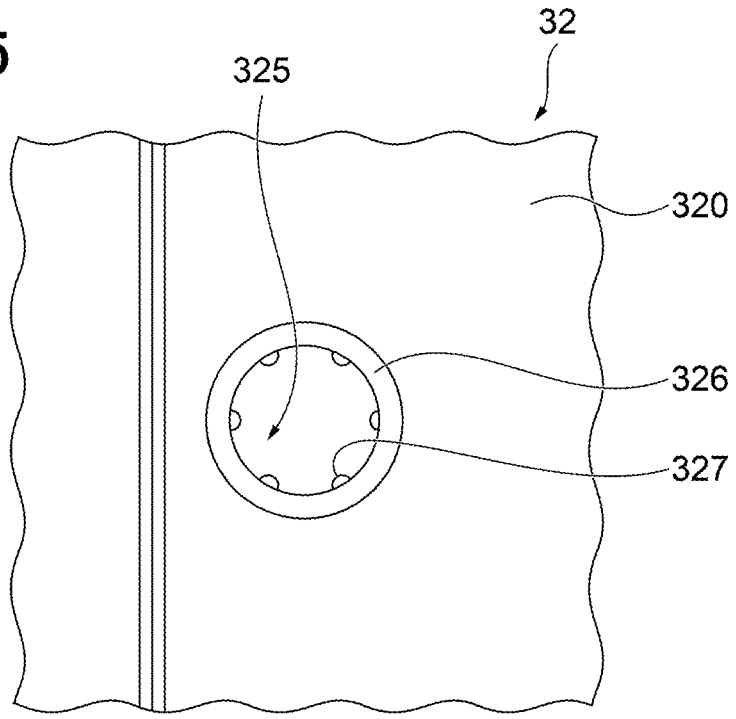
FIG. 5 shows a cross-section view of the opening held by the shroud of the radiator fan device shown in FIG. 1.
Figure 6:
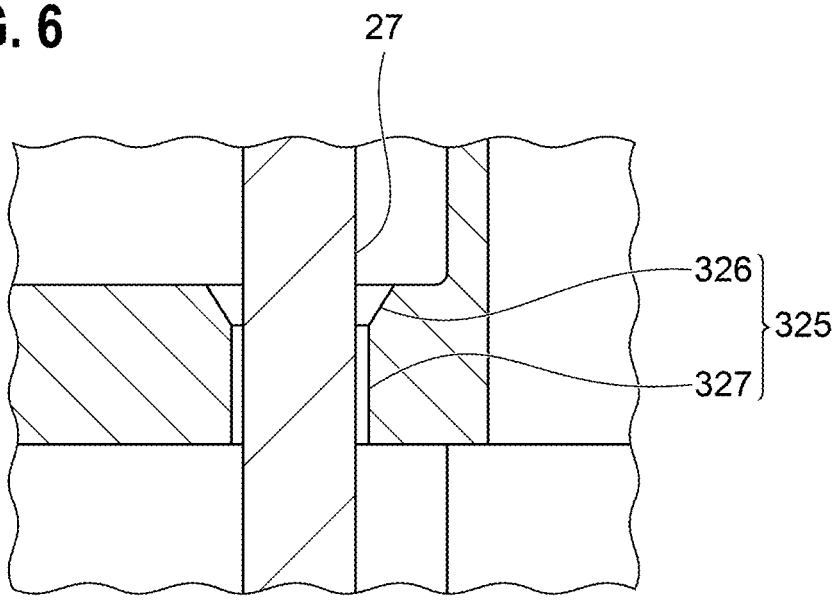
FIG. 6 shows a front view of the hole shown in FIG. 5.

FIG. 4 is a front view of the engaged part 321 of the motor anchor part 32 with the shroud 30 of the radiator fan device 1. In FIG. 4, the illustration of components provided around the motor anchor part 32 in the radiator fan device 1 is omitted to illustrate the shape of the motor anchor 32 and the engaged part 321. FIG. 5 is a front view of an opening 325 having a shroud 30 of a radiator fan device 1. FIG. 6 is a cross-section view of an opening 325.

As shown in FIGS. 3-5, the motor anchor part 32 has a base plate 320, an engaged part 321, a positioning part 322, and an opening 325.

As shown in FIG. 3, the base plate 320 is a site for securing the motor 20 to the shroud 30. The base plate 320 is formed, for example, in a flat plate, corresponding to the shape of the bottom surface 224 to ensure contact with the bottom surface 224 of the stator core 222 of the motor 20.

As shown in FIG. 4, the base plate 320 is provided with a convex-shaped engaged part 321, for example, at or near the center of the plane. The engaged part 321 is a site that engages the motor anchor part 32 and the stator core 222 by engaging the engaging part 223. The engaged part 321 has a shape that is engageable with the engaging part 223 provided in the stator core 222. The engaged part 321 is, for example, a cylindrical or generally cylindrical convexity formed in a convex shape from the base plate 320 facing the bottom surface 224 of the stator core 222 towards the axial superior side in the context of the motor anchor part 32 and the stator core 222 engaging.

As shown in FIG. 4, the positioning part 322 is a convex-shaped site towards the circumferential side provided on the cylindrical or generally cylindrical circumferential surface 324 of the engaged part 321. The positioning part 322 is provided on a cylindrical or generally cylindrical circumferential surface 324 of the engaged part 321 in a plurality in a circumferential directions of the positioning part 322. At the motor anchor part 32, the number of positioning parts 322, the spacing of the plurality of positioning parts 322, or the shape of the positioning parts 322 can be set as appropriate. The engaged part 321 mates with the engaging part 223 by the positioning part 322 contacting the inner circumferential surface of the engaging part 223.

As shown in FIGS. 5 and 6, the shroud 30 is provided with a opening 325 for passing through an energized part 27, such as a magnet wire, terminal, bus bar, etc., from the motor 20. The opening 325 can be provided with a taper shape 326 for entrainment above the axis direction through which the energized part 27 is inserted to facilitate positioning of the energized part 27. If the energized part 27 is a rigid part, the energized part 27 and the opening 325 can be used as energized part positioning parts to position the motor 20 relative to the shroud 30. It is also possible to provide a protrusion 327 in the opening 325, which is a convex-shaped site towards the peripheral side.

It should be noted that the shroud 30 may be equipped with electronic components that constitute control circuitry for controlling operation of the motor 20.

The rotor 6 is secured to the rotation axis 22 to support the permanent magnet 61 at the outer circumference of the stator 21. The rotor 6 comprises a circular or generally circular cylinder 62 covering the outer periphery of the stator 21 and supporting the permanent magnet 61 in the inner periphery, and a circular or generally circular top surface 63 covering the upper side of the stator 21. The rotor 6 is secured to the rotation axis 22. Specifically, one end 226 of the axial top end of the rotation axis 22 is located on the top surface 63 side of the rotor 6. The hub 11 is secured to the top surface 63 of the rotor 6.

Next, the action of the radiator fan device 1 comprising the above described configuration will be described.

According to the radiator fan device 1 described above, the shroud 30 of the resin material may be provided with a motor anchor part 32 that secures the stator core 222 of the motor 20, thereby reducing the weight and cost of the discontinued parts because it is not necessary to provide the motor 20 with parts such as a plate that secures the motor 20 and the shroud 30.

According to the radiator fan device 1 described above, a bearing retaining hole 211 for holding a pair of bearings 23 in the stator core 222 can be utilized as the engaging part 223. In addition, according to the radiator fan device 1, the shroud 30 and motor 20 can be positioned by an in row-shaped positioning part 322 held in the engaged part 321 on the shroud 30 side.

According to the radiator fan device 1 described above, the energized part positioning part, which is composed of a positioning part 322 provided in the engaged part 321, and an energized part positioning part 27 and an opening 325, can assemble accurately the energized part 27 while positioning to the shroud 30. Also, since the rotation axis 22 is fixed to the rotor 6 side, the high strength metal plate required to secure the rotation axis 22 to the stator 21 side can be omitted. If the rotation axis 22 is directly fixed to the resin shroud without using the above plate, the assembly accuracy will be insufficient or the rotation accuracy of the rotation axis 22 will be worse.

Thus, weight reduction can be achieved according to the radiator fan device 1 described above.

In addition, those skilled in the art may modify the invention as appropriate in accordance with conventionally known knowledge. As long as such modifications still embody the construction of the present invention, they are of course included in the scope of the present invention.

In the radiator fan device 1 described above, the shape of the engaging part 223 and the engaged part 321 is not limited to the shapes described above. That is, in a radiator fan device, the shape of the engaging part and the engaged part is not limited to a cylindrical or generally cylindrical shape, and a variety of shapes can be employed, such as, for example, a rectangle shape or generally rectangle shape, provided that the stator core of the motor and the motor anchoring part of the shroud can be secured.

In the radiator fan device 1, the engaging part 223 is not limited to those using a part of the bearing retaining holes 211 described above, but can also be provided independently of, for example, the bearing retaining holes 211.

In the radiator fan device 1, the engaging part and the engaged part are not limited to the concave-shaped engaging part 223 and the convex-shaped engaged part 321 as described above, provided that the stator core of the motor and the motor anchor part of the shroud can be secured, so the concave-convex relationship may be different.

In the radiator fan device 1, the shape of the positioning part 322 is not limited, and the positioning part 322 may not be provided in the engaged part 321.

Although for the motor 20 described above, we have described an example of a brushless DC (DC) motor, the present invention is not limited to this. In addition, the motor anchor part 32 that secures the motor 20 is an example provided in the shroud 30, but it is a versatile structure that can be used in all outer rotor motors.

Various examples/embodiments are described herein for various apparatuses, systems, and/or methods. Numerous specific details are set forth to provide a thorough understanding of the overall structure, function, manufacture, and use of the examples/embodiments as described in the specification and illustrated in the accompanying drawings. It will be understood by those skilled in the art, however, that the examples/embodiments may be practiced without such specific details. In other instances, well-known operations, components, and elements have not been described in detail so as not to obscure the examples/embodiments described in the specification. Those of ordinary skill in the art will understand that the examples/embodiments described and illustrated herein are non-limiting examples, and thus it can be appreciated that the specific structural and functional details disclosed herein may be representative and do not necessarily limit the scope of the embodiments.

Reference throughout the specification to "examples, "in examples," "with examples," "various embodiments," "with embodiments," "in embodiments," or "an embodiment," or the like, means that a particular feature, structure, or characteristic described in connection with the example/embodiment is included in at least one embodiment. Thus, appearances of the phrases "examples, "in examples," "with examples," "in various embodiments," "with embodiments," "in embodiments," or "an embodiment," or the like, in places throughout the specification are not necessarily all referring to the same embodiment. Furthermore, the particular features, structures, or characteristics may be combined in any suitable manner in one or more examples/embodiments. Thus, the particular features, structures, or characteristics illustrated or described in connection with one embodiment/example may be combined, in whole or in part, with the features, structures, functions, and/or characteristics of one or more other embodiments/examples without limitation given that such combination is not illogical or non-functional. Moreover, many modifications may be made to adapt a particular situation or material to the teachings of the present disclosure without departing from the scope thereof.

It should be understood that references to a single element are not necessarily so limited and may include one or more of such element. Any directional references (e.g., plus, minus, upper, lower, upward, downward, left, right, leftward, rightward, top, bottom, above, below, vertical, horizontal, clockwise, and counterclockwise) are only used for identification purposes to aid the reader's understanding of the present disclosure, and do not create limitations, particularly as to the position, orientation, or use of examples/embodiments.

"One or more" includes a function being performed by one element, a function being performed by more than one element, e.g., in a distributed fashion, several functions being performed by one element, several functions being performed by several elements, or any combination of the above.

It will also be understood that, although the terms first, second, etc. are, in some instances, used herein to describe various elements, these elements should not be limited by these terms. These terms are only used to distinguish one element from another. For example, a first element could be termed a second element, and, similarly, a second element could be termed a first element, without departing from the scope of the various described embodiments. The first element and the second element are both elements, but they are not the same element.

The terminology used in the description of the various described embodiments herein is for the purpose of describing particular embodiments only and is not intended to be limiting. As used in the description of the various described embodiments and the appended claims, the singular forms "a", "an" and "the" are intended to include the plural forms as well, unless the context clearly indicates otherwise. It will also be understood that the phrase at least one of successive elements separated by the word "and" (e.g., "at least one of A and B") is to be interpreted the same as the term "and/or" and as used herein refers to and encompasses any and all possible combinations of one or more of the associated listed items. It will be further understood that the terms "includes," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof.

Joinder references (e.g., attached, coupled, connected, and the like) are to be construed broadly and may include intermediate members between a connection of elements, relative movement between elements, direct connections, indirect connections, fixed connections, movable connections, operative connections, indirect contact, and/or direct contact. As such, joinder references do not necessarily imply that two elements are directly connected/coupled and in fixed relation to each other. Connections of electrical components, if any, may include mechanical connections, electrical connections, wired connections, and/or wireless connections, among others. Uses of "e.g." and "such as" in the specification are to be construed broadly and are used to provide non-limiting examples of embodiments of the disclosure, and the disclosure is not limited to such examples.

While processes, systems, and methods may be described herein in connection with one or more steps in a particular sequence, it should be understood that such methods may be practiced with the steps in a different order, with certain steps performed simultaneously, with additional steps, and/or with certain described steps omitted.

As used herein, the term "if" is, optionally, construed to mean "when" or "upon" or "in response to determining" or "in response to detecting," depending on the context. Similarly, the phrase "if it is determined" or "if [a stated condition or event] is detected" is, optionally, construed to mean "upon determining" or "in response to determining" or "upon detecting [the stated condition or event]" or "in response to detecting [the stated condition or event]," depending on the context.

All matter contained in the above description or shown in the accompanying drawings shall be interpreted as illustrative only and not limiting. Changes in detail or structure may be made without departing from the present disclosure.

The invention claimed is:

1. A radiator fan device, comprising:

a fan including a hub and a plurality of blades projecting from the hub;

a motor connected to the fan and configured to rotationally drive the fan, the motor including:

a stator including a stator core, the stator core including a bearing retention hole;

a rotational axis disposed in the bearing retention hole to which the fan is mounted and rotatably supporting the rotational axis relative to the stator core; and a plurality of bearings arranged within the bearing retention hole; and a shroud overlying the fan and the motor;

wherein the shroud integrally includes:

a shroud body overlying the fan and the motor; and a motor anchor part securing the motor to the shroud;

wherein the motor anchor part includes an annular projection protruding into the bearing retention hole and engaging the stator core; and wherein the annular projection is offset from the plurality of bearings in an axial direction.

2. The radiator fan device according to claim 1, wherein the motor anchor part further includes a base plate on which the annular projection is disposed.

3. The radiator fan device according to claim 2, wherein the base plate is a flat plate.

4. The radiator fan device according to claim 2, wherein the base plate has a shape corresponding to a shape of a bottom surface of the stator core of the stator.

5. The radiator fan device according to claim 1, wherein the annular projection includes a plurality of positioning parts protruding from the annular projection and engaging the stator core.

6. The radiator fan device according to claim 5, wherein:

the plurality of positioning parts are a plurality of protrusions disposed on and protruding from an outer circumferential surface of the annular projection; and the plurality of protrusions abut an inner circumferential surface of the stator core that defines the bearing retention hole.

7. The radiator fan device according to claim 6, wherein the plurality of protrusions are arranged on the outer circumferential surface of the annular projection spaced apart from one another in a circumferential direction.

8. The radiator fan device according to claim 5, wherein:

the plurality of positioning parts protrude from a surface of the annular projection extending transversely to the base plate; and the plurality of positioning parts abut a surface of the stator core that defines the bearing retention hole.

9. The radiator fan device according to claim 1, wherein the shroud further includes an opening through which at least a portion of the motor is passable.

10. The radiator fan device according to claim 9, wherein the opening of the shroud includes a tapered portion and an untapered portion.

11. The radiator fan device according to claim 9, wherein the shroud further includes a plurality of axially extending protrusions projecting radially into the opening.

12. The radiator fan device according to claim 9, wherein the motor further includes an energized part disposed in and extending through the opening of the shroud.

13. The radiator fan device according to claim 12, wherein the energized part is a magnet wire, a terminal, and/or a bus bar.

14. The radiator fan device according to claim 1, wherein:

the shroud further includes a positioning opening;

the motor includes a positioning part complimentary to the positioning opening; and the positioning part of the motor is received by the positioning opening of the shroud when the motor is properly positioned relative to the shroud.

15. The radiator fan device according to claim 1, wherein the annular projection is arranged in axial alignment with at least one of the plurality of bearings.

16. The radiator fan device according to claim 1, wherein:

the motor anchor part further includes a base plate and an elevated region protruding from the base plate; and the annular projection is disposed on and protrudes from an axial end of the elevated region.

17. The radiator fan device according to claim 16, wherein the stator core is at least partially arranged on the axial end of the elevated region of the motor anchor part.

18. The radiator fan device according to claim 16, wherein:

the plurality of bearings includes a first bearing and a second bearing; and the second bearing is arranged axially between the first bearing and a distal end of the annular projection disposed opposite the elevated region of the base plate.

19. A radiator fan device, comprising:

a fan including a hub and a plurality of blades projecting from the hub;

a motor configured to rotationally drive the fan, the motor connected to the fan and at least partially arranged in the hub; and a shroud including:

a shroud body overlying the fan and the motor;

a motor anchor part engaged with the motor and securing the motor to the shroud; and an opening through which at least a portion of the motor is passable;

wherein the opening of the shroud includes a tapered portion and an untapered portion;

wherein the motor includes:

a stator including a stator core, the stator core including a bearing retention hole;

a rotational axis disposed in the bearing retention hole to which the fan is mounted; and a pair of bearings arranged within the bearing retention hole and rotatably supporting the rotational axis relative to the stator core; and wherein the motor anchor part includes an annular projection engaged with the stator core and disposed offset from the pair of bearings in an axial direction.

* * * * *